US006874401B2

(12) United States Patent
Bishop et al.

(10) Patent No.: US 6,874,401 B2
(45) Date of Patent: Apr. 5, 2005

(54) STRUCTURE AND METHOD FOR CONTAINING THE DETONATION OF AN EXPLOSIVE

(75) Inventors: Edward C. Bishop, Manassas, VA (US); Deepak Bhinge, Fairfax, VA (US); Sean M. Buckley, Arlington, VA (US)

(73) Assignee: Parsons Corporation, Pasadena, CA (US)

( * ) Notice: Subject to any disclaimer, the term of this patent is extended or adjusted under 35 U.S.C. 154(b) by 0 days.

(21) Appl. No.: 10/411,669

(22) Filed: Apr. 10, 2003

(65) Prior Publication Data

US 2004/0200339 A1 Oct. 14, 2004

(51) Int. Cl.[7] ..... F42B 39/30
(52) U.S. Cl. ..... 86/50
(58) Field of Search ..... 86/50

(56) References Cited

U.S. PATENT DOCUMENTS 377,732 A * 2/1888 Adams ..... 2/2.5
3,986,310 A * 10/1976 van den Broek ..... 52/169.9
4,621,559 A * 11/1986 Ohlson ..... 86/50
5,044,252 A * 9/1991 Gamadi et al. ..... 86/50
5,076,168 A * 12/1991 Yoshida et al. ..... 102/303
6,302,026 B1 * 10/2001 Parkes ..... 102/303
6,439,120 B1 * 8/2002 Bureaux et al. ..... 102/303
6,514,009 B2 * 2/2003 Northcott et al. ..... 405/53

* cited by examiner

*Primary Examiner*—Teri Pham Luu
*Assistant Examiner*—Bret Hayes
(74) *Attorney, Agent, or Firm*—Denton L. Anderson; Sheldon & Mak

(57) ABSTRACT

A modular containment structure kit comprises (i) a plurality of elongate members, (ii) a plurality of rectangular, planar side wall members, (iii) a plurality of rectangular, planar roof members, and (iv) a plurality of rectangular, planar metal plates. A method for the handling of the explosive includes the steps of (a) providing the modular structure kit, (b) using the kit to assemble a containment structure around the explosive while avoiding obstacles near the explosive, and (c) handling the explosive within the containment structure.

20 Claims, 7 Drawing Sheets

STRUCTURE AND METHOD FOR CONTAINING THE DETONATION OF AN EXPLOSIVE

FIELD OF THE INVENTION

This invention relates generally to methods for containing the detonation and resulting fragmentation of an explosive and, more particularly, to methods which employ a containment structure in the containing of the detonation and resulting fragmentation of an explosive.

BACKGROUND OF THE INVENTION

Unexploded bombs, land mines and other unexploded ordnance present a very risky handling problem. Often, the unexploded device is buried under the top soil and must be carefully exposed by excavation. Where an unexploded device is discovered in an area proximate to populated neighborhoods, the handling of such device presents a significant risk to surrounding people and property.

The preferred method of handling an explosive discovered at a particular site is to first surround the explosive with a suitable containment structure which will contain any unintended detonation of the explosive and which will contain the resulting fragmentation of the detonated explosive. There are problems, however, with the use of such containment structures. The erection of custom-built containment structures is generally expensive and time-consuming. However, the use of prefabricated containment structures is often unsatisfactory as well. This is because such prefabricated containment structures are of a predetermined size and shape. The problem in this regard is that explosives are often discovered in locations crowded with various obstacles, such as buildings, trees, boulders and hillocks. Unless a prefabricated containment structure is available which happens to fit among the various obstacles at the site where the explosive is located, a prefabricated containment structure cannot be used.

Accordingly, there is a need for a method for handling explosives which avoids these problems in the prior art.

SUMMARY OF THE INVENTION

The invention satisfies this need. The invention is a unique method for surrounding an explosive with a containment structure.

The method comprises the steps of (a) providing a plurality of elongate support members, each elongate support member comprising at least two channels running substantially the entire length of the elongate support member, some of the channels in some of the elongate support members being disposed back to back and some of the channels in some of the elongate support members being disposed at right angles to one another, (b) providing a plurality of rectangular, planar side wall members, the side wall members having one or more lengths and four side wall edges, (c) providing a plurality of rectangular, planar roof members, the roof members having one or more lengths and roof peripheral edges, and (d) providing a plurality of rectangular, planar metal plates, (e) assembling a containment structure using the elongate support members, side walls members, roof members and metal plates. The containment structure is custom designed to surround the explosive and to avoid the obstacles at the location. The containment structure is assembled by (i) constructing side walls which surround an area having the explosive but which avoids the obstacles at the location, the side walls comprising a plurality of side wall members whose side wall peripheral edges are retained within the channels of the elongate support members, each side wall being attached to one or more adjacent side walls by elongate support members, (ii) constructing a roof which encloses the area surrounded by the side walls, the roof comprising a plurality of roof members whose roof peripheral edges are retained within the channels of elongate support members, the roof being attached to the side walls by elongate support members, and (iii) disposing metal plates in abutment with the side walls and with the roof. Thereafter, the explosive is safely handled within the containment structure. Any inadvertent detonation of the explosive and any resultant shrapnel is safely contained within the containment structure.

The invention is also a kit comprising the plurality of support members, side wall members, roof members and metal plates.

Finally, the invention is also a modular containment structure assembled from the kit described above.

The invention provides the ability to quickly and inexpensively construct a containment structure around an explosive. The containment structure is easily made to conform to the site where the explosion is located.

DRAWINGS

These features, aspects and advantages of the present invention will become better understood with regard to the following description, appended claims and accompanying figures where:

DETAILED DESCRIPTION

The following discussion describes in detail several embodiments of the invention and several variations of those embodiments. This discussion should not be construed, however, as limiting the invention to those particular embodiments. Practitioners skilled in the art will recognize numerous other embodiments as well.

The invention is a method for safely handling an explosive at a specific location having obstacles proximate to the location. In the method, a modular containment structure 10 is assembled around the explosive in such a way so as to avoid the obstacles at the site.

Figure 1:
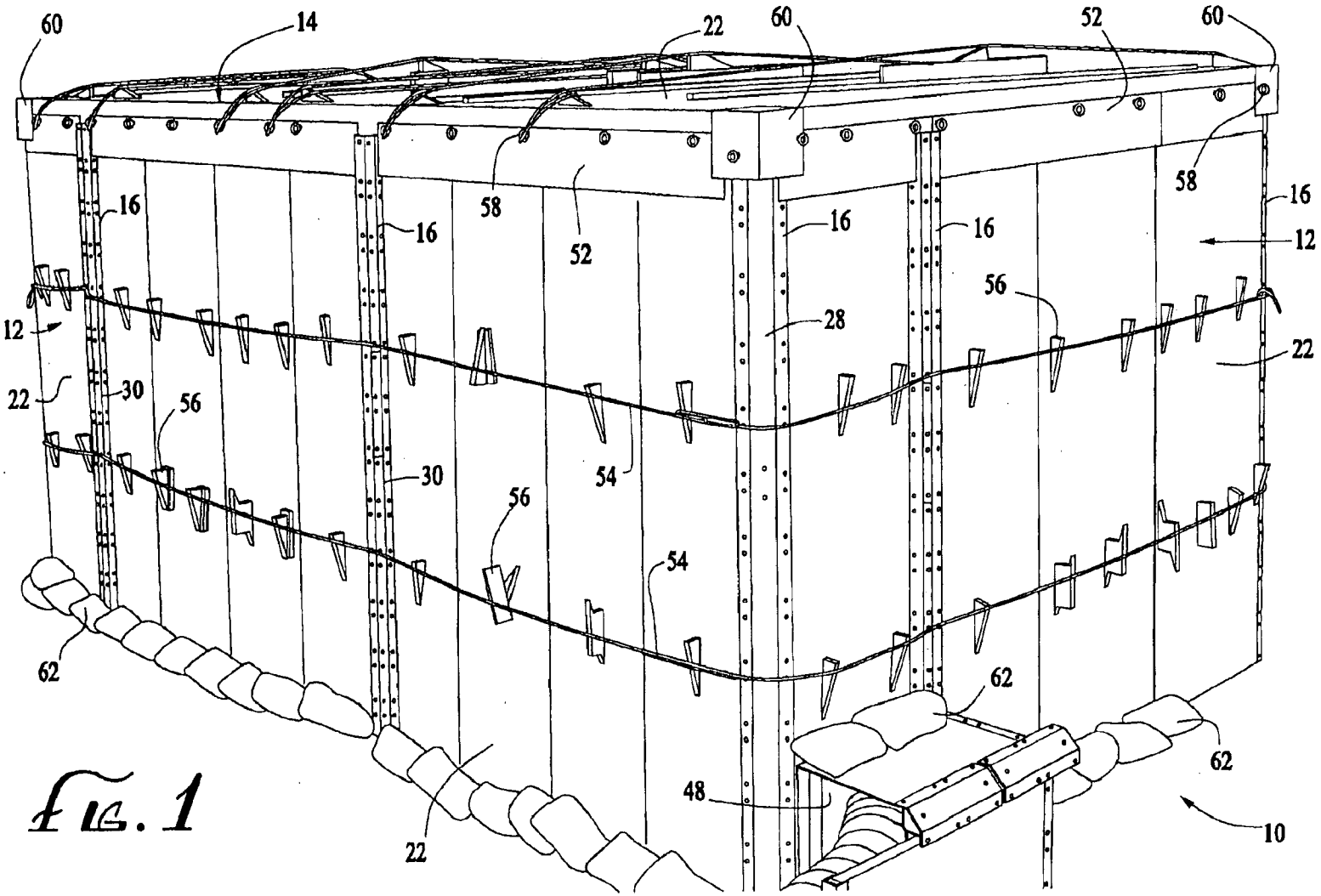
FIG. 1 is a perspective view of a first containment structure having features of the invention.
Figure 2:
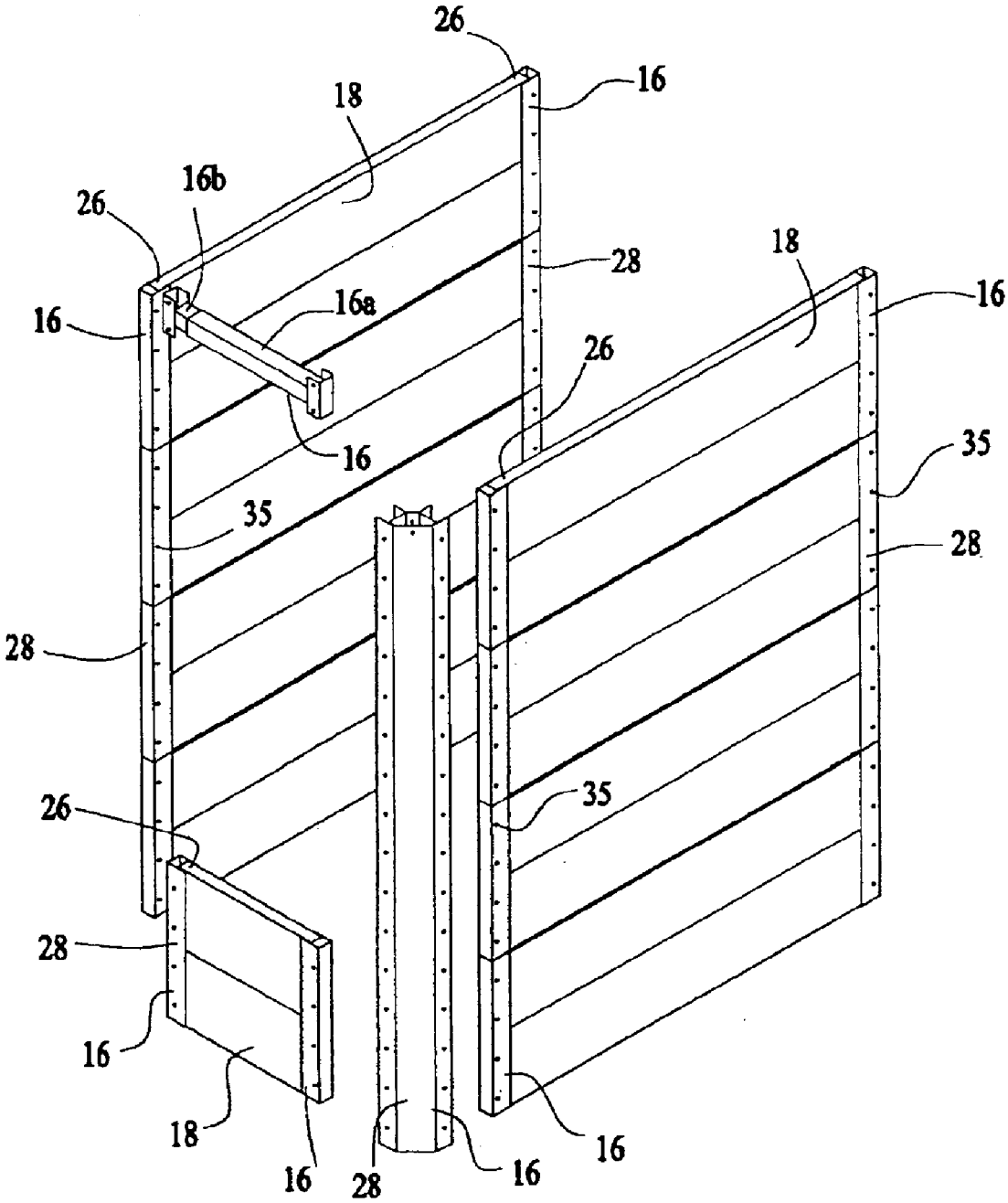
FIG. 2 is an exploded view of components useable in the construction of the containment structure illustrated in FIG. 1.
Figure 3:
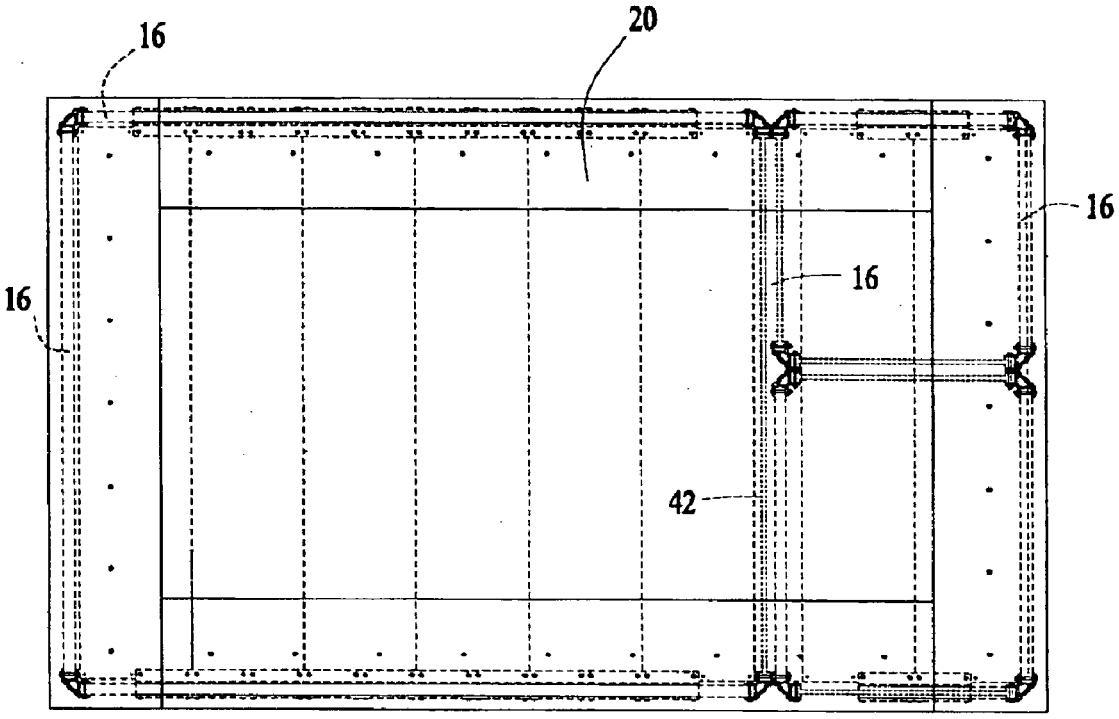
FIG. 3 is a top view of a second containment structure having features of the invention.
Figure 4:
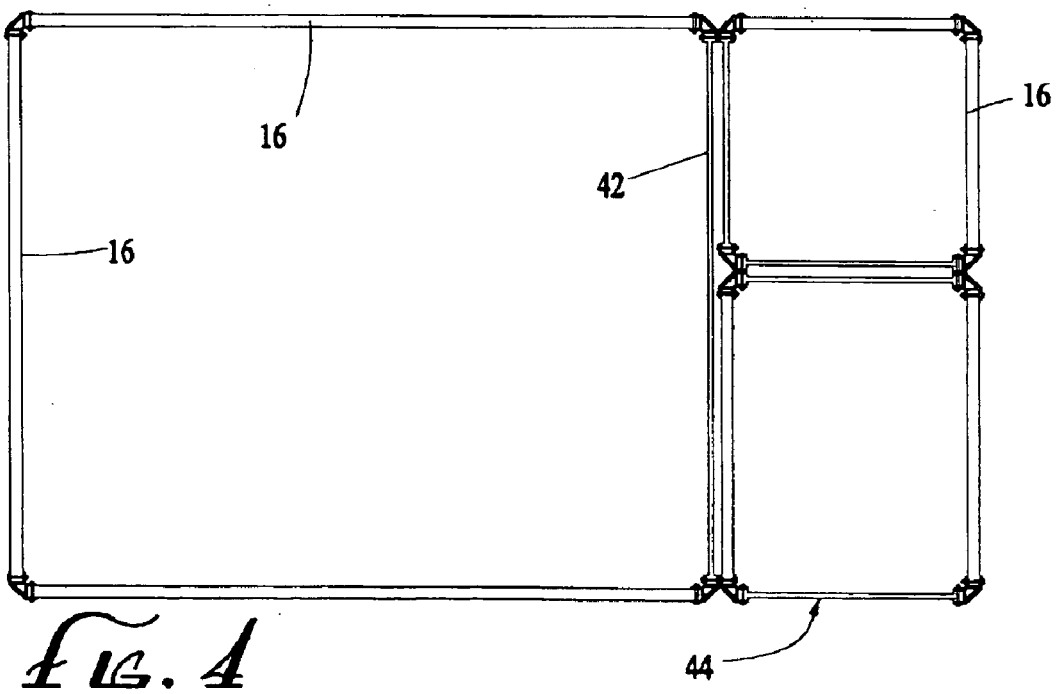
FIG. 4 is a top view of the internal skeleton of the containment structure illustrated in FIG. 3.
Figure 5:
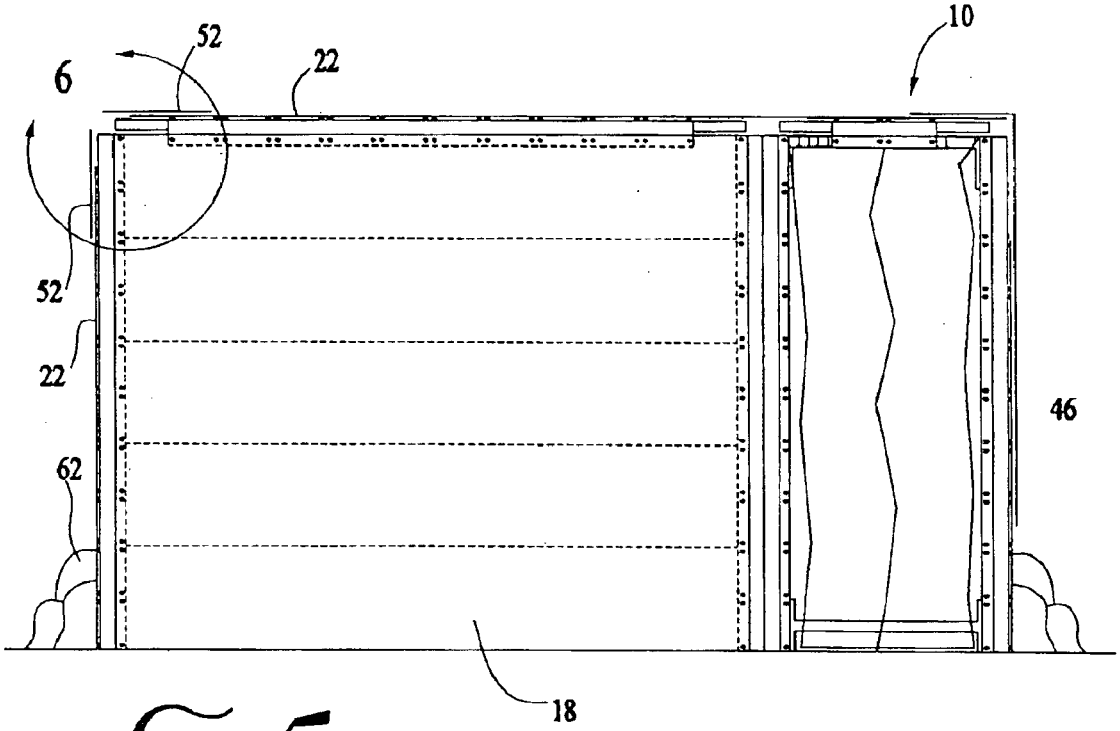
FIG. 5 is a side view of the containment structure illustrated in FIG. 3.

FIGS. 1, 3, 7 and 9 illustrate a containment structures 10 useful in the method. Each containment structure 10 has a plurality of side walls 12 and a roof 14. The containment structure 10 is assembled from a plurality of elongate support members 16, side wall members 18 (as illustrated in FIG. 2), roof members 20 and metal plates 22.

Figure 12:
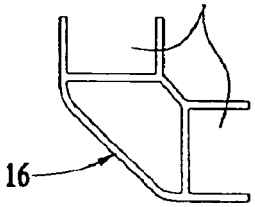
FIG. 12 is an end view of an elongate support member useable in the invention.
Figure 13:
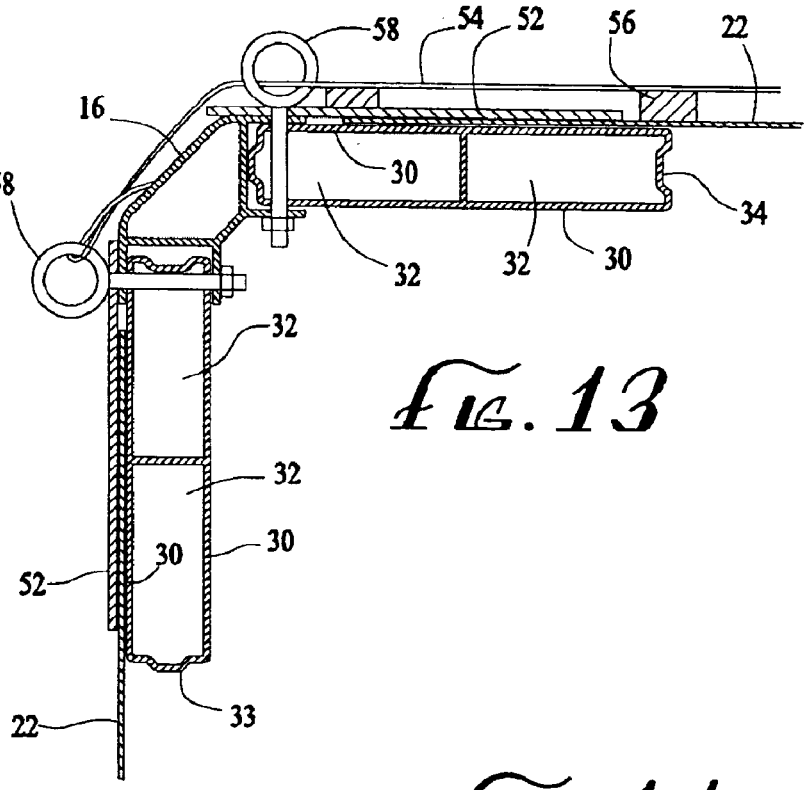
FIG. 13 is a detail cross-sectional view of a corner of the containment structure illustrated in FIG. 10.
Figure 14:
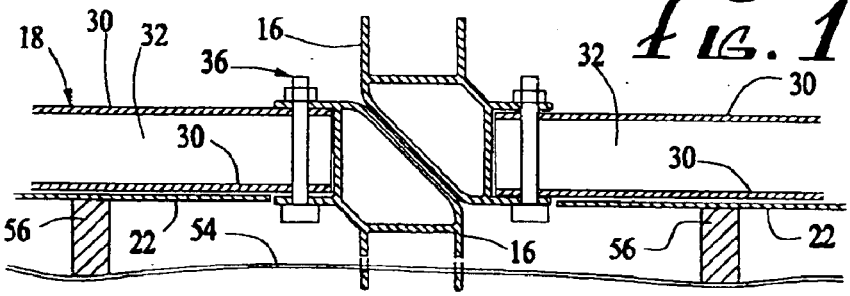
FIG. 14 is a cross-sectional detail view of a wall section of a containment structure having features of the invention.

Each elongate support member 16 comprises at least two channels 24 running substantially the entire length of the elongate support member 16. The width of the channels 24 are sized and dimensioned to accept the peripheral edges 26 of the side wall members 18 and the roof members 20. The channels 24 of some of the elongate support members 16 can be disposed back to back. As illustrated in FIG. 12, the channels 24 in other elongate support members 16 are supported at right angles to one another. A pair of this latter type of elongate support members 16 can be welded back to back to provide an elongate support member 16 having four channels 24 which are each disposed at a 90° angle with respect to adjacent channels 24 (as illustrated in FIG. 14).

The elongate support member 16 can also be a tee post elongate support member (not shown). The tee post elongate support member has a pair of channels 24 disposed back to back and one channel 24 disposed at right angles to the other two channels 24.

The elongate support members 16 are typically fixed in length, each elongate support member 16 is typically being between about 2 feet and about 10 feet in length.

As illustrated in FIG. 2, some of the elongate support members 16 can be adjustable with respect to length. Such adjustable elongate support members 16 have a pair of support member portions 16*a* and 16*b* which are slidably disposed with respect to one another. In the embodiment illustrated in FIG. 2, the support member portions 16*a* and 16*b* are disposed with respect to one another in telescopic fashion. Typically, the adjustable elongate support members 16 have several positive lock settings. In one example, the lock settings are provided by a locking pin disposed through both of the support member portions 16*a* and 16*b*.

The elongate support members 16 can be used as vertical support members 28 to retain side wall members 18. In this regard, the vertical support members 28 can be disposed as intermediate supports 30 within the side walls 12 or for the connecting of two perpendicular side walls 12. The elongate support members 16 can also be disposed horizontally to retain side wall members 18 or roof members 20 or to connect a side wall 12 to the roof 14.

The side wall members 18 are typically rectangular and planar. Each side wall member 18 has four opposed side wall peripheral edges 26. Typically, all of the widths of the side wall members 18 are the same, although this is not necessary. Typically, each of the side wall members 18 is about 2 feet in width and has a length of between about 8 feet and about 16 feet.

Typically, each side wall member 18 comprises a metal sheet 30. In one embodiment of the invention, the side wall member 18 comprises a pair of parallel aluminum alloy sheets 30 spaced apart by a distance of about 2 inches. Disposed between the two aluminum alloy sheets 30 is a plastic foam core 32. The aluminum alloy sheets 30 are typically between about 0.181 inches and about 0.25 inches in thickness.

Typically, each side wall member 18 has a pair of opposed long peripheral edges 26 and a pair of opposed short peripheral edges 26. One of the long peripheral edges 26 of each of the side wall members 18 can define a projecting tongue, and the opposed long peripheral edge 26 of the side wall members 18 defines a matching groove. The matching groove is sized and dimensioned to accept and retain an identical projecting tongue disposed upon the long peripheral edge 26 of another side wall member 18 having an identical configuration.

The roof members 20 are also typically rectangular and planar. The roof members 20 can be identical to the side wall members 18, but this is not necessary. Each roof member 20 has four opposed side peripheral edges 26. Typically, all of the widths of the roof members 20 are the same, although this is not necessary. Typically, each of the roof members 20 is either 1 foot or 2 feet in width and have lengths of between about 8 feet and about 16 feet.

Like the side wall members 18, the roof members 20 can comprise a pair of parallel aluminum alloy sheets 30 spaced apart by a distance of about 2 inches and disposed between the two aluminum sheets 30 is a foam core 32.

Like the side wall members 16, each roof member 20 has a pair of opposed long peripheral edges 26 and a pair of opposed short peripheral edges 26. One of the long peripheral edges 26 of each of the roof members 20 can define a projecting tongue 33, and the opposed long peripheral edge 26 of the roof member 20 can define a matching groove 34. The matching groove 34 is sized and dimensioned to accept and retain an identical projecting tongue 33 disposed upon the long peripheral edge 26 of another roof member 20 having an identical configuration.

In the embodiment illustrated in the drawings, the elongate support members 16, the side wall peripheral edges 26 and the roof peripheral edges 26 comprise a plurality of spaced apart apertures 35. The apertures 35 in the elongate support members 16 match the size and location of the apertures 35 in both the side wall members 18 and in the roof members 20, so that, when the periphery 26 of a side wall member 18 or a roof member 20 is disposed within an elongate support member 16, fastening pins 36 can be inserted through an aperture 35 in the elongate support member 16 and an aperture 35 in the periphery 26 to securely retain the side wall member 18 or the roof member 20 within the elongate support member 16. The pins 36 can be any appropriate retaining pins. In a typical embodiment, the pins 36 comprise an elongate pin portion 38 and a separate keeper portion 40. In one such embodiment, the pin portion 38 is an externally threaded bolt and the keeper portion 40 is an internally threaded nut. In another embodiment, the pin portion 38 is an unthreaded pin with a head at one end and a transverse bore at the other end. In this embodiment, the keeper portion 40 can be a cotter pin disposed within the transverse bore.

Elongate support structures 16, side wall members 18, roof members 20, fastening pins 36 and other related hardware useable in the invention can be purchased from Speed Shore Corporation of Houston, Tex.

The metal plates 22 typically are aluminum plates having a thickness between about ⅛ inch and about ⅜ inch. Additional metal plates 22 can be disposed on top of the aluminum plates on the roof 14 or contiguous with metal plates 22 on the side walls 12 as necessary to provide additional strength.

Typically, the containment structure 10 is sufficiently heavy so that the inadvertent detonation of an explosive within the containment structure 10 raises the containment structure 10 above the location by a distance of less than about ¼ inch.

In one embodiment, the containment structure 10 is sufficiently strong to contain shrapnel from the explosion of a 75 mm Mk II chemical round. If a larger explosive is to be handled, additional metal plates 22 can be used to increase the containment strength of the containment structure 10.

Each of the component parts, including the plurality of elongate support members 16, side wall members 18, roof members 20 and metal plates 22 can be assembled to form a kit.

As illustrated in FIGS. 1 and 3–14, the containment structures 10 can be easily custom designed to surround the explosive and to avoid the obstacles at the location. The containment structure 10 is assembled by constructing side walls 12 which surround an area having the explosive but which avoid the obstacles at the location. The side walls 12 comprise a plurality of the side wall members 18. The side wall peripheral edges 26 are retained within the channels 24 of the elongate support members 16. Each side wall member 18 is attached to one or more adjacent side wall members 18 by elongate support members 16.

As illustrated in the drawings, side wall members 18 can be used to create interior walls 42. Such interior walls 42 can be used to shield an access opening 44 from the interior of the containment structure 10. As illustrated in the drawings, a plastic or cloth curtain 46 can be disposed over the access opening 44.

Also as illustrated in the drawings, apertures 48 can be disposed in the side walls 12 to provide ingress and egress for ventilating air. The ventilated air can be heated or cooled as necessary by a heater or air conditioner unit disposed exterior to the containment structure 10.

The containment structure 10 can be assembled around an excavating machine 50 or other large tools which are too massive to enter the containment structure 10 via the access opening 44. Alternatively, such excavating machine 50 or other large tools can be dropped into the containment structure 10 with a crane at any time prior to the completion of the roof 14.

After the side walls 12 are assembled, a roof 14 is constructed which encloses the area surrounded by the side walls 12. The roof 14 comprises a plurality of roof members 20 whose roof peripheral edges 26 are retained within the channels 24 of the elongate support members 16. The roof 14 is attached to the side wall members 18 by elongate support members 16.

Figure 6:
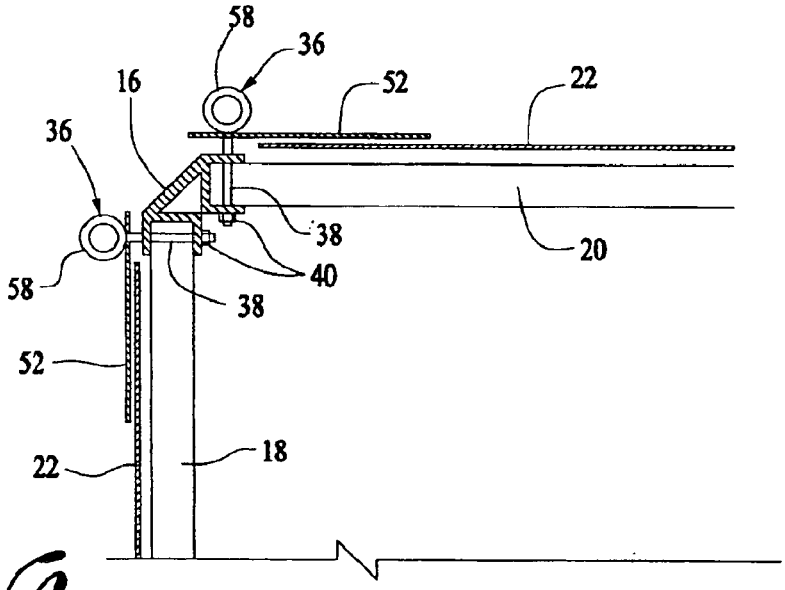
FIG. 6 is a detail cross-sectional view of the corner of the containment structure illustrated in FIG. 5.
Figure 8:
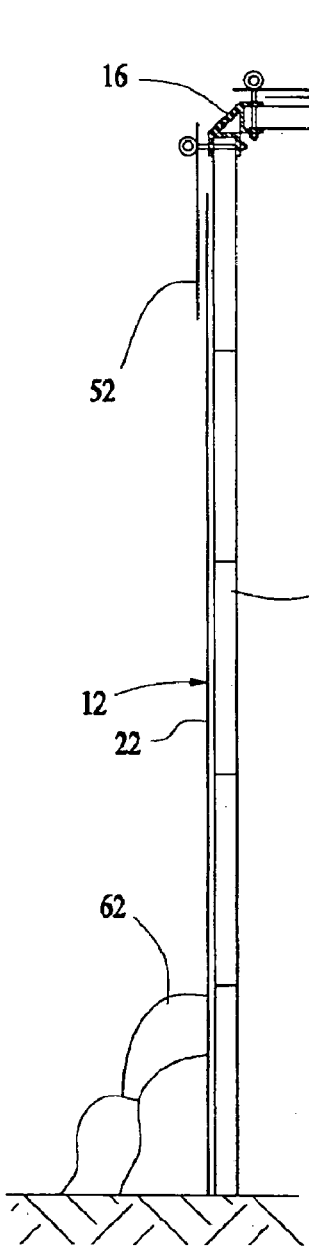
FIG. 8 is a detail view in partial cross-section of one of the walls of the containment structure illustrated in FIG. 7.
Figure 7:
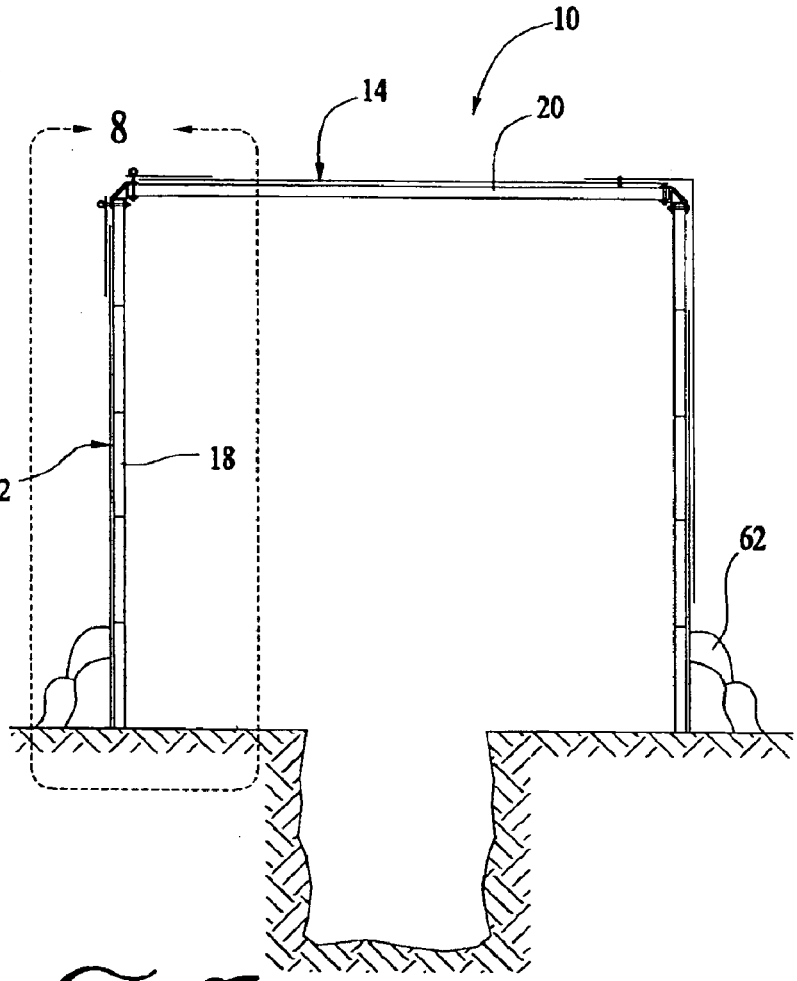
FIG. 7 is a cross-sectional view of a third containment structure having features of the invention, showing the structure at a site.
Figure 9:
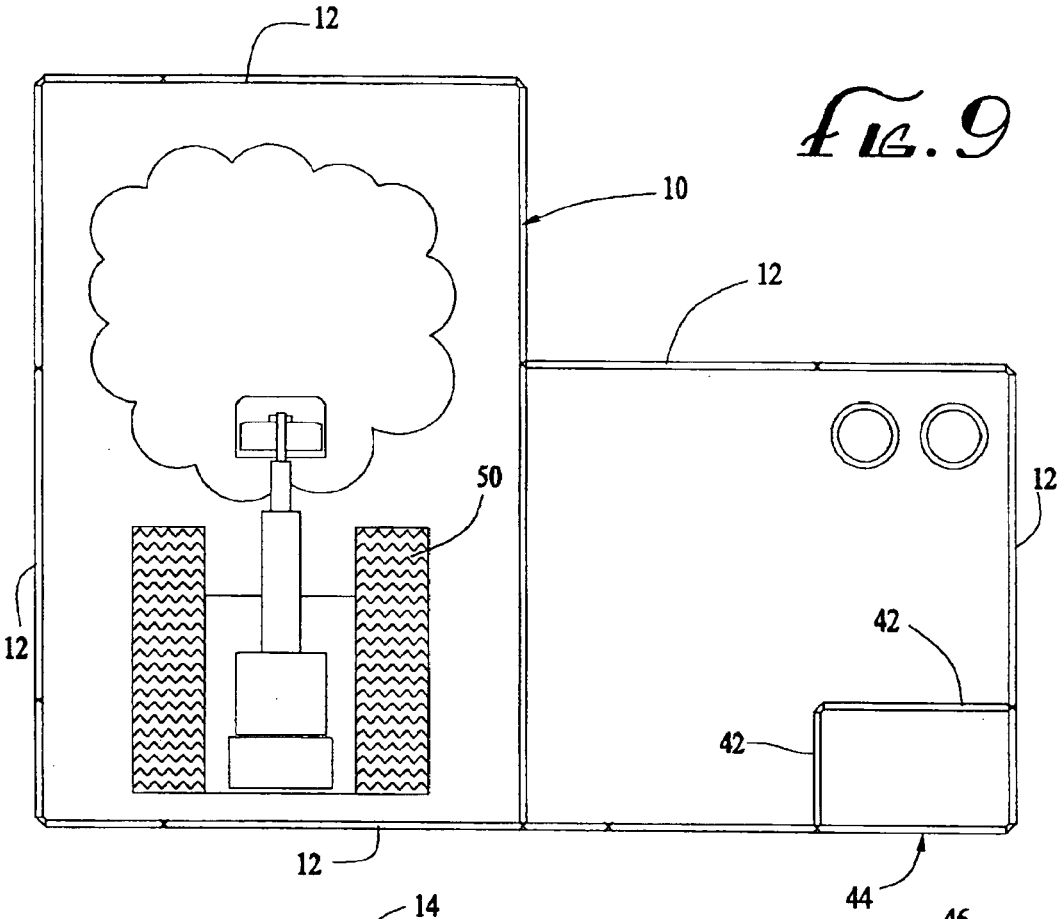
FIG. 9 is a top view a fourth containment structure having features of the invention.
Figure 10:
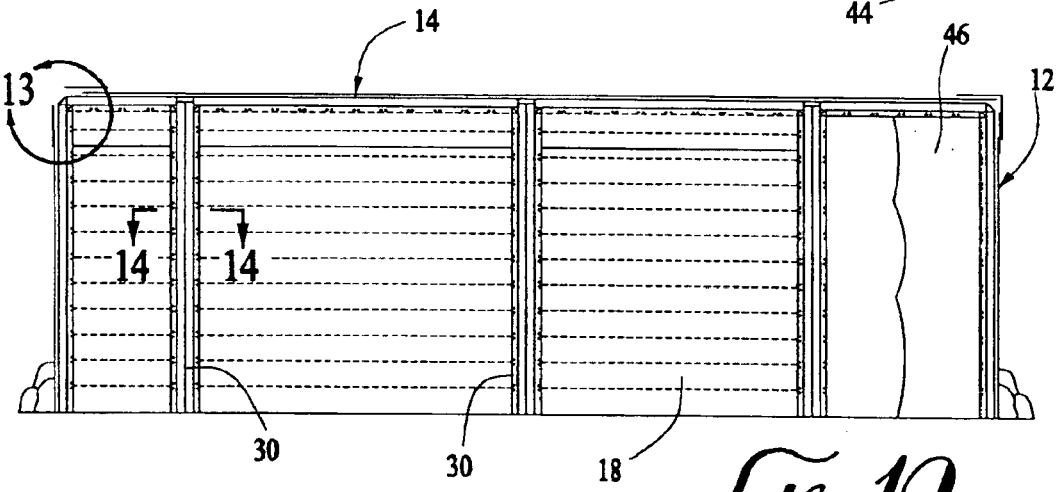
FIG. 10 is a side view of the containment structure illustrated in FIG. 9.
Figure 11:
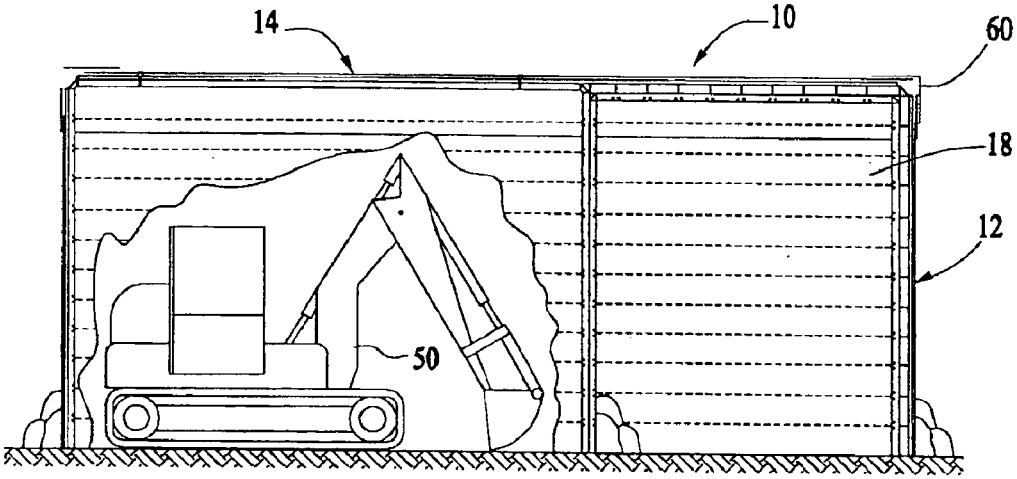
FIG. 11 is a side view in partial cross-section of the containment structure illustrated in FIG. 9.

After the side walls 12 and the roof 14 are completed, the metal plates 22 are disposed in abutment with the side walls 12 and with the roof 14. The metal plates 22 are then tentatively retained against the side walls 12 and the roof 14 by upper periphery lateral plates 52 which are attached to the metal plates 22 and to the elongate support members 16 as illustrated in FIG. 6. Thereafter, the metal plates 22 are tightened against the side walls 12 and the roof 14 with ropes or straps 54 as illustrated in FIG. 1. Wedges 56, such as wooden wedges, are disposed between the ropes or straps 54 and the metal plates 22 to tightly hold the metal plates 22 against the side walls 12 and the roof 14. As illustrated in FIG. 1, the fastening pins 36 along opposed elongate support members 16 on opposite sides of the roof 14 can be eyebolts 58 to guide and retain ropes or straps 54 used to press the metal plates 22 against the roof 14.

Any corner gaps in the coverage of the metal plates 22 can be covered with metal corner blocks 60, as illustrated in FIG. 1.

As illustrated in the drawings, it is typical to dispose sandbags 62 at least around the exterior of the containment structure 10.

The invention provides a method for quickly, conveniently and inexpensively constructing a containment structure around an unexploded ordnance or other explosive. Because the method provides for the assembling of the containment structure from preconstructed elements, the containment structure can be conveniently made to conform to the typography at the explosion site.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A method for handling an explosive which is disposed at a specific location having obstacles proximate to the explosive, the method comprising the steps of:

(a) providing a plurality of elongate support members, each elongate support member comprising at least two channels running substantially the entire length of the elongate support member, some of the channels in some of the elongate support members being disposed back to back and some of the channels in some of the elongate support members being disposed at right angles to one another;

(b) providing a plurality of rectangular, planar side wall members, the side wall members having at least two different lengths, the side wall members having four side wall peripheral edges;

(c) providing a plurality of rectangular, planar roof members, the roof members having at least two different lengths, the roof members having four roof peripheral edges; and (d) providing a plurality of rectangular, planar metal plates;

(e) attaching back to back at least one pair of the elongate support members having channels which are disposed at right angles to one another so as to provide an elongate support member having four channels each disposed at a 90° angle with respect to adjacent channels;

(f) assembling a containment structure using the elongate support members, side walls members, roof members and metal plates, the containment structure being custom designed to surround the explosive and to avoid the obstacles at the location, the containment structure being assembled by:

(i) constructing side walls which surround an area having the explosive but which avoids the obstacles at the location, the side walls comprising a plurality of side wall members whose side wall peripheral edges are retained within the channels of the elongate support members, each side wall being attached to one or more adjacent side walls by elongate support members;

(ii) constructing a roof which encloses the area surrounded by the side walls, the roof comprising a plurality of roof members whose roof peripheral edges are retained within the channels of elongate support members, the roof being attached to the side walls by elongate support members; and (iii) disposing metal plates in abutment with the side walls and with the roof; and (g) thereafter, handling the explosive within the containment structure;

whereby any inadvertent detonation of the explosive and any resultant shrapnel therefrom is safely contained within the containment structure.

2. The method of claim 1 wherein each side wall member and each roof member comprises a thermoplastic foam core sandwiched between two metal sheets.

3. The method of claim 1 wherein the containment structure is sufficiently heavy so that the detonation of the explosive raises the containment structure above the location by a distance of less than ¼ inch.

4. The method of claim 1 wherein the containment structure is sufficiently strong to contain shrapnel from the explosion of a 75 mm Mk II chemical round.

5. The method of claim 1 wherein each side wall member and each roof member has a pair of opposed long peripheral edges and wherein one of the two long peripheral edges defines a projecting tongue and wherein the opposite long peripheral edge defines a matching groove which is sized and dimensioned to accept and retain an identical tongue disposed upon the long peripheral edge of another side wall member or roof member.

6. The method of claim 1 wherein the elongate support members, the side wall peripheral edges and the roof peripheral edges comprise a plurality of spaced apart apertures, the apertures in the elongate support members matching the size and location of the apertures in both the side wall members and in the roof members so that, when the periphery of a side wall member or a roof member is disposed within an elongate support member, fastening pins can be inserted through an aperture in the elongate member and an aperture in the periphery to securely retain the side wall or the roof member within the elongate support member.

7. The method of claim 1 wherein a plurality of the elongate support members comprise a pair of support member portions which are slidably disposed with respect to one another such that each such support member having a pair of support member portions is adjustable with respect to length.

8. The method of claim 1 further comprising the step of disposing sandbags around the entirety of the base of the containment structure.

9. A method for the contained detonation of an explosive which is disposed at a specific location having obstacles proximate to the explosive, the method comprising the steps of:

(a) providing a plurality of elongate support members, each elongate support member comprising at least two channels running substantially the entire length of the elongate support member, some of the channels in some of the elongate support members being disposed back to back and some of the channels in some of the elongate support members being disposed at right angles to one another, each of the elongate support members having a plurality of spaced apart apertures, some of the elongate support members comprising a pair of support member portions which are slidably disposed with respect to one another, such that each such support member having a pair of support member portions is adjustable with respect to length;

(b) providing a plurality of rectangular, planar side wall members, the side wall members having at least two different lengths, the side wall members having four side wall peripheral edges, the roof members comprising a foamed thermoplastic core sandwiched between a pair of metal plates, the roof peripheral edges comprising a plurality of spaced apart apertures, the spaced apart apertures matching the size and location of the apertures in the elongate support members so that, when the peripheral edge of a side wall member is disposed within an elongate support member, fastening pins can be inserted through apertures in the elongate member and apertures in the peripheral edge of the side wall member to securely retain the side wall member within the elongate support member, each side wall member further comprising a pair of opposed long peripheral edges, one of each such long peripheral edges defining a projecting tongue and the opposite long peripheral edge defining a matching groove which is sized and dimensioned to accept and retain an identical tongue disposed upon the long peripheral edge of another roof member;

(c) providing a plurality of rectangular, planar roof members, the roof members having at least two different lengths, the roof members having four roof peripheral edges, the roof members comprising a foamed thermoplastic core sandwiched between a pair of metal plates, the roof peripheral edges comprising a plurality of spaced apart apertures, the spaced apart apertures matching the size and location of the apertures in the elongate support members so that, when the periphery of a roof member is disposed within an elongate support member, fastening pins can be inserted through an aperture in the elongate member and an aperture in the periphery of the roof member to securely retain the roof member within the elongate support member, each roof member further comprising a pair of opposed long peripheral edges, one of each such long peripheral edges defining a projecting tongue and the opposite long peripheral edge defining a matching groove which is sized and dimensioned to accept and retain a similar tongue disposed upon the long peripheral edge of another roof member;

(d) providing a plurality of fastening pins; and (e) providing a plurality of rectangular, planar metal plates;

(f) attaching back to back at least one pair of the elongate support members which are disposed at right angles to one another so as to provide an elongate support member having four channels each disposed at a 90° angle with respect to adjacent channels;

(g) assembling a non-rectangular containment structure using the kit, the containment structure being custom designed to surround the explosive and to avoid the obstacles at the location, the containment structure being assembled by:

(i) constructing side walls which surround an area having the explosive but which avoid the obstacles at the location, the side walls comprising a plurality of side wall members whose side wall peripheral edges are retained within the channels of elongate support members by the fastening pins, each side wall being attached to one or more adjacent side walls by elongate support members;

(ii) constructing a roof which encloses the area surrounded by the side walls, the roof comprising a plurality of roof members whose roof peripheral edges are retained within the channels of elongate support members by the fastening pins, the roof being attached to the side walls by elongate support members; and (iii) disposing metal plates in abutment with the side walls and with the roof;

(h) disposing sandbags around the base of the containment structure; and (i) thereafter, handling the explosive within the containment structure;

whereby any inadvertent detonation of the explosive and any resultant shrapnel therefrom is safely contained within the containment structure.

10. A kit for constructing a modular containment structure, the kit comprising:

(a) a plurality of elongate support members, each elongate support member comprising at least two channels running substantially the entire length of the elongate support member, some of the channels in some of the elongate support members being disposed back to back and some of the channels in some of the elongate support members being disposed at right angles to one another, at least one pair of the elongate support members having channels which are disposed at right angles to one another being attached back to back so as to provide an elongate support member having four channels each disposed at a 90° angle with respect to adjacent channels;

(b) a plurality of rectangular, planar side wall members, the side wall members having at least two different lengths, the side wall members having four side wall peripheral edges;

(c) a plurality of rectangular, planar roof members, the roof members having at least two different lengths, the roof members having four roof peripheral edges; and (d) a plurality of rectangular, planar metal plates.

11. The kit of claim 10 wherein each side wall member and each roof member comprises a foam core sandwiched between two metal sheets.

12. The kit of claim 10 wherein each side wall member and each roof member has a pair of opposed long peripheral edges and wherein one of the two long peripheral edges defines a projecting tongue and wherein the opposite long peripheral edge defines a matching groove which is sized and dimensioned to accept and retain an identical tongue disposed upon the long peripheral edge of another side wall member or roof member.

13. The kit of claim 10 wherein the elongate support members, the side wall peripheral edges and the roof peripheral edges comprise a plurality of spaced apart apertures, the apertures in the elongate support members matching the size and location of the apertures in both the side wall members and in the roof members so that, when the periphery of a side wall member or a roof member is disposed within an elongate support member, fastening pins can be inserted through an aperture in the elongate member and an aperture in the periphery to securely retain the side wall or the roof member within the elongate support member.

14. The kit of claim 10 wherein a plurality of the elongate support members comprise a pair of support member portions which are slidably disposed with respect to one another such that each such support member having a pair of support member portions is adjustable with respect to length.

15. A non-rectangular modular containment structure comprising a plurality of side walls and a roof, (a) the containment structure being assembled from a containment structure kit comprising:

(i) a plurality of elongate support members, each elongate support member comprising at least two channels running substantially the entire length of the elongate support member, some of the channels in some of the elongate support members being disposed back to back and some of the channels in some of the elongate support members being disposed at right angles to one another, at least one pair of the elongate support members having channels which are disposed at right angles to one another being attached back to back so as to provide an elongate support member having four channels each disposed at a 90° angle with respect to adjacent channels;

(ii) a plurality of rectangular, planar side wall members, the side wall members having at least two different lengths, the side wall members having four side wall peripheral edges;

(iii) a plurality of rectangular, planar roof members, the roof members having at least two different lengths, the roof members having four roof peripheral edges; and (iv) a plurality of rectangular, planar metal plates;

(b) the containment structure being assembled from the modular containment kit by an assembly method comprising the steps of:

(i) constructing side walls which surround an area having the explosive but which avoid the obstacles at the location, the side walls comprising a plurality of side wall members whose side wall peripheral edges are retained within the channels of elongate support members, each side wall being attached to one or more adjacent side walls by elongate support members;

(ii) constructing a roof which encloses the area surrounded by the side walls, the roof comprising a plurality of roof members whose roof peripheral edges are retained within the channels of elongate support members, the roof being attached to the side walls by elongate support members; and (iii) disposing metal plates in abutment with the side walls and with the roof;

whereby the containment structure is sufficiently strong to contain shrapnel from the explosion of a 75 mm Mk II chemical round.

16. The structure of claim 15 wherein each side wall member and each roof member comprises a thermoplastic foam core sandwiched between two metal sheets.

17. The structure of claim 15 wherein each side wall member and each roof member has a pair of opposed long peripheral edges and wherein one of the two long peripheral edges defines a projecting tongue and wherein the opposite long peripheral edge defines a matching groove which is sized and dimensioned to accept and retain an identical tongue disposed upon the long peripheral edge of another side wall member or roof member.

18. The structure of claim 15 wherein the elongate support members, the side wall peripheral edges and the roof peripheral edges comprise a plurality of spaced apart apertures, the apertures in the elongate support members matching the size and location of the apertures in both the side wall members and in the roof members so that, when the periphery of a side wall member or a roof member is disposed within an elongate support member, fastening pins can be inserted through an aperture in the elongate member and an aperture in the periphery to securely retain the side wall or the roof member within the elongate support member.

19. The structure of claim 15 wherein a plurality of the elongate support members comprise a pair of support member portions which are slidably disposed with respect to one another such that each such support member having a pair of support member portions is adjustable with respect to length.

20. The structure of claim 15 wherein sandbags are disposed around the periphery of the base of the side walls.

* * * * *